United States Patent [19]

Schwartz et al.

[11] Patent Number: 4,756,247

[45] Date of Patent: Jul. 12, 1988

[54] APPARATUS FOR CONVERSION OF A PRINTING PRESS TO OFFSET PRINTING

[76] Inventors: Michael A. Schwartz, 1073 Ponca St., Batavia, Ill. 60510; Toshio Yamagata, 450 W. Briar Pl., Chicago, Ill. 60657

[21] Appl. No.: 423,868

[22] Filed: Sep. 27, 1982

Related U.S. Application Data

[62] Division of Ser. No. 275,208, Jun. 19, 1981, Pat. No. 4,414,895.

[51] Int. Cl.[4] ..... B41F 7/04; B41F 5/06; B41F 13/40

[52] U.S. Cl. ..... 101/177; 101/180; 101/182; 101/247; 101/DIG. 28

[58] Field of Search ..... 101/247, 218, 177, 137, 101/139, 180, 140, 143, 144, 145, 182, 184, 185, 351, 352, DIG. 28, 220–225; 91/4 R

[56] References Cited

U.S. PATENT DOCUMENTS

| | | | |
|---|---|---|---|
| 1,599,199 | 9/1926 | Bayles | 91/4 X |
| 2,490,823 | 12/1949 | Manning | 91/4 |
| 2,569,034 | 9/1951 | Auer | 101/247 |
| 3,177,664 | 4/1965 | Konkge | 91/4 X |
| 3,259,060 | 7/1966 | Martin | 101/247 X |
| 4,119,031 | 10/1978 | Ottenhues | 101/153 |
| 4,301,728 | 11/1981 | Jaffe et al. | 101/247 |

*Primary Examiner*—J. Reed Fisher

*Attorney, Agent, or Firm*—Allegretti, Newitt, Witcoff & McAndrews, Ltd.

[57] ABSTRACT

An apparatus and method converts an existing printing press to offset printing. An auxiliary frame and two auxiliary impression cylinders are mounted to the press and existing cylinders are adapted for offset printing. A new web path is defined to the cylinders, through an auxiliary cross brace member. The shafts of auxiliary cylinders are eccentrically mounted dead shafts. The cylinder surface is friction driven by the web. Bearers smooth the movement of the cylinders across the blanket slots. The auxiliary cylinders are maintained on impression by an incompressible fluid for uniform impression and thrown off rapidly by a pressurized gas.

2 Claims, 6 Drawing Sheets

50
46
48
32
34
44
66
84
54
30
6
68
70
20
86
88
16
28
14
24

APPARATUS FOR CONVERSION OF A PRINTING PRESS TO OFFSET PRINTING

This is a division of application Ser. No. 275,208, filed June 19, 1981, now U.S. Pat. No. 4,414,895, issued on Nov. 15, 1983.

BACKGROUND OF THE INVENTION

This invention relates generally to a printing press, and more particularly, to a method and apparatus for converting letterpress and dilithographic printing presses to wet and dry offset printing.

As a result of greatly increasing operating costs and advances in print quality, the newspaper industry has been abandoning letterpress and dilitho printing in favor of offset printing. Until recently, newspaper publishers have had little opinion in this change but to abandon their letterpress and dilitho printing presses as they abandoned letterpress and dilitho printing. As a result, the expense of new offset printing presses has stood as an obstacle to the adoption of offset printing, thereby depriving the public and industry of offset printing advantages.

Attention has focused on the conversion of letterpress and dilitho printing presses to offset printing. Advances have been made, but present conversion methods and equipment have required extensive reconstruction of presses, including the scrapping of many press cylinders. Present methods and equipment also fail to achieve high operating efficiency, maintainability, simplicity, dependability and the highest quality printing. An example of a present method and apparatus is provided by U.S. Pat. No. 4,250,809, issued Feb. 17, 1981. In this example, conversion requires the replacement of the plate cylinders and impression cylinders of the press, and the inclusion of a massive auxiliary frame and bulky replacement cylinders. The conversion also requires integration of gear drives for the replacement cylinders into the existing gear train, with a resultant increase in the load on the drive. Conversion takes extensive time, and involves great expense.

SUMMARY OF THE INVENTION

A primary object of the invention is to provide a method and apparatus for converting existing printing presses to offset printing, with no scrapping of press cylinders and without extensive reconstruction, in a minimum of time and expense.

Another primary object is to provide a converted, offset press with high operating efficiency, maintainability, simplicity, dependability and the highest quality offset printing.

These and others are the objects of the invention, which has several principal aspects. In one aspect, the invention is an apparatus for converting an existing web fed printing press into a web fed offset printing press, where the existing press has a main frame with two main side frame members and an existing cross brace member mounted on the two main side frame members, a spaced pair of existing plate cylinders and a spaced pair of existing impression cylinders all mounted on the main frame. The apparatus comprises an auxiliary frame, two auxiliary impression cylinders, means for adapting the existing impression cylinders, and means for moving the auxiliary cylinders into impression contact.

The auxiliary frame is mounted to the main frame through the use of existing mounting means on the main frame. The auxiliary frame includes an auxiliary cross brace member. This member defines a web slot, and is mounted to the two main side frame members in place of the existing cross brace member. Two auxiliary side frame members are mounted to the auxiliary cross brace member and the main side frame members. The two auxiliary impression cylinders are rotatably mounted on the auxiliary side frame members adjacent the existing impression cylinders and are friction driven by the web. The adapting means adapts the existing impression cylinders to offset blanket cylinders, and the plate cylinders to offset plate cylinders. The means for moving the auxiliary cylinders moves the auxiliary cylinders into offset impression contact with the blanket cylinders.

The apparatus defined a web path through the web slot. The pat extends to one of the auxiliary impression cylinders, and around the one auxiliary impression cylinder between the one auxiliary impression cylinder and one of the blanket cylinders. The path continues to the other of the auxiliary impression cylinders, and around the other auxiliary impression cylinder between the other auxiliary impression cylinder and the other blanket cylinder.

With this apparatus, the press is operable for offset printing.

As should be apparent, conversion of a press to offset priinting according to the invention involves minimal reconstruction of the press. The existing plate and impression cylinders are retained, in converted form. The auxiliary frame is mounted on the main frame through existing mounting means on the main frame. The auxiliary cross brace member is a direct replacement of the existing cross brace member. The auxiliary impression cylinders are friction driven, without need of gear drives requiring integration into the existing gear train.

As a result, conversion occurs with minimal time and expense. The converted press retains the dependability of the existing cylinders, and has no additional, comples equipment requiring intensive maintenance. The converted press has high efficiency, maintainability, simplicity, dependability and high quality offset printing.

The other principal aspects, objects and advantages of the invention are too numerous to be summarized here. As a result, all this information is provided in the Detailed Description, which follows.

BRIEF DESCRIPTION OF THE DRAWING

The preferred embodiment of this invention is described in the following Description in relation to the accompanying drawing. This drawing consists of 7 figures. The figures are briefly described as follows.

DETAILED DESCRIPTION OF THE PREFERRED EMBODIMENT

Figure 1:
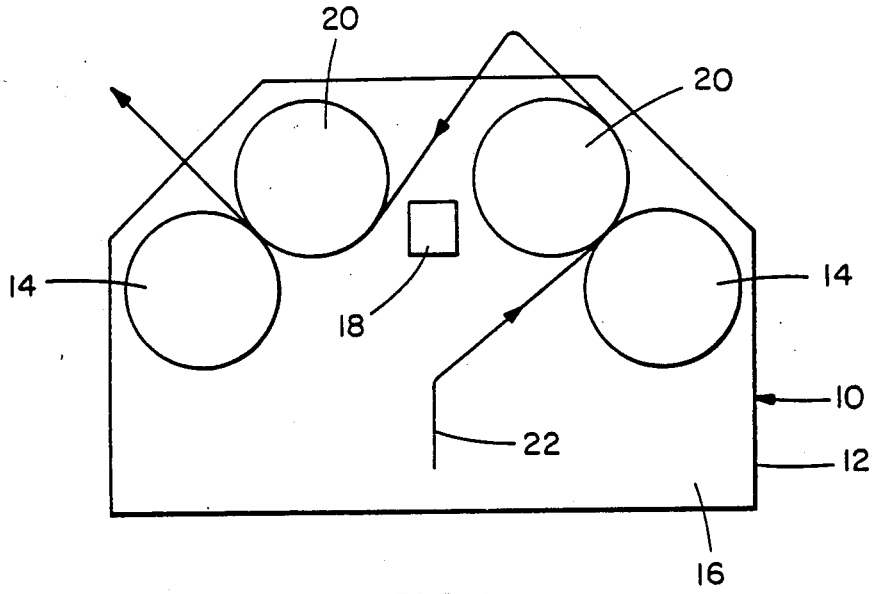
FIG. 1—FIG. 1 is a schematic view of a printing press prior to conversion to offset printing through use of the preferred embodiment.

Referring to FIG. 1, a letterpress printing press 10, before conversion of offset printing, includes a main frame 12. A pair of horizontally spaced, letterpress plate cylinders 14 are mounted on the frame 12, between the spaced, main side frame members 16 (one is shown). The side frame members 16 are joined by a cross brace member 18, and the cylinders 14 are end mounted for rotation about central axes, between the side frame members 16. Two horizontally spaced, impression cylinders 20 are also end mounted on the frame 12 for rotation. The impression cylinders 20 are located inward and upward of the plate cylinders 14. The impression cylinders 20 make letterpress impression contact with the plate cylinders 14, to impress print upon a web 22. The press 10 has a web path extending through the nip between one of the plate cylinders 14 and one of the impression cylinders 20, and around the one cylinder 20. The web path continues around the other cylinder 20, and between the other cylinder 20 and other cylinder 14. With this path, the web 22 is printed once on each surface, as for black-on-white newsprint. Other webs paths may be defined, for other print, such as two color, single surface print. The press 10 may also include other cylinders, as in color hump, double color hump and color deck configurations.

Figure 2:
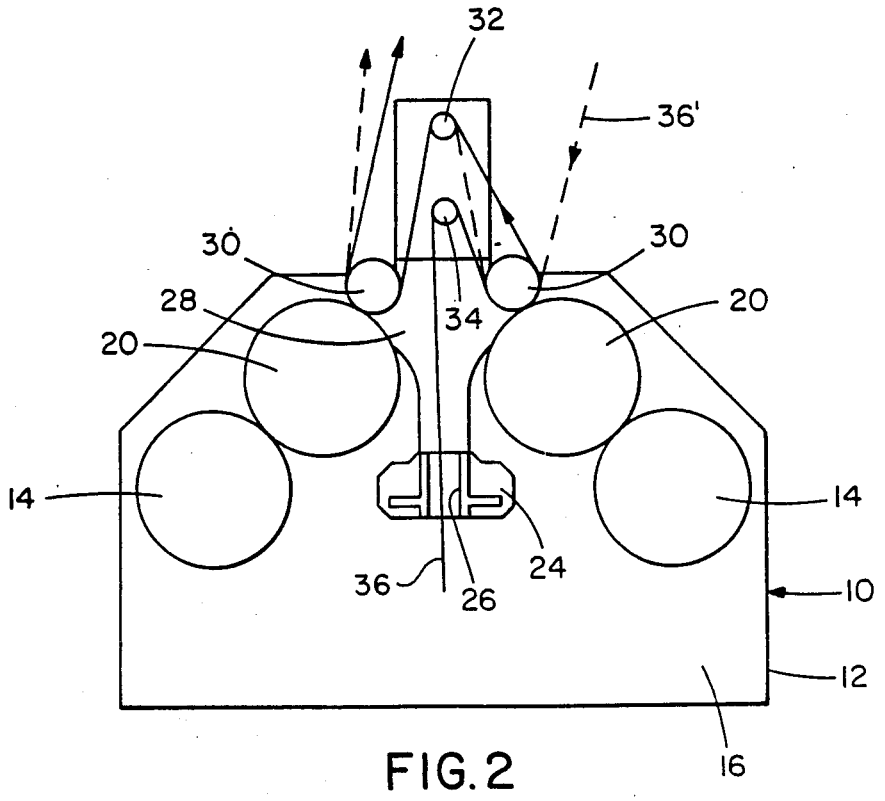
FIG. 2—FIG. 2 is a schematic view of the press of FIG. 1 after conversion.

Referring to FIG. 2, the press 10, after conversion according to the invention, retains the main frame 12 and the cylinders 14, 20. The existing cross brace member 18 is replaced by an auxiliary cross brace member 24, which defines a web slot 26. The cylinders 14 and modified, by shims, to accept offset printing plates, and the letterpress blankets on the impression cylinders 20 are replaced by offset blankets, to convert the cylinders 20 to offset blanket cylinders. Auxiliary side frame members 28 (one is shown) are mounted on the auxiliary cross member 24 and the main side frame members 16, within the main side frame members 16. Two new, auxiliary impression cylinders 30 are end mounted for rotation between the auxiliary side frame members 28, along with a compensating roller 32 and pipe roller 34. The impression cylinders 30 are mounted upward and inward of the blanket cylinders 20, one adjacent each blanket cylinder 20. As will be explained, means is provided for moving the auxiliary impression cylinders 30 into offset impression contact with the blanket cylinders 20. The rollers 32, 34 are mounted upward of the cylinders 30, midway therebetween.

A new web path 36 is defined. The path 36 extends through the web slot 26 to the pipe roller 34. The path continues around the pipe roller 34 and to one of the impression cylinders 30. The path continues around the one cylinder 30, between the one cylinder and one of the blanket cylinders 20. The web then travels to and about the compensating roller 32, and to and about the other impression cylinder 30, between the other cylinder and the other blanket cylinder 20. Ink is transferred from the offset plate cylinders 14, to the blanket cylinders 20, thereby to the web. Thus, the web is offset printed, once on each surface. Other web paths may be defined, as shown by phantom path 36' in FIG. 2.

Figure 3:
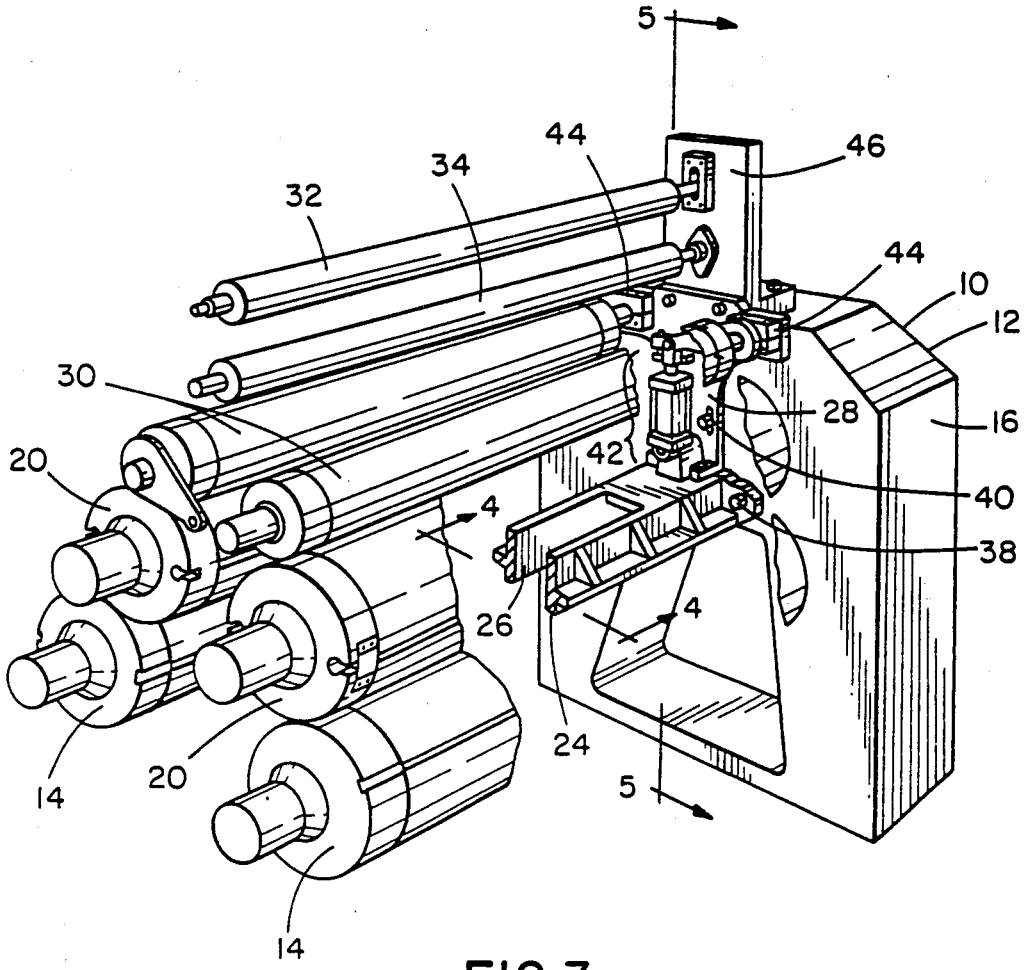
FIG. 3—FIG. 3 is a partial, pictorial, perspective view of the converted press of FIG. 2.

Referring now to FIG. 3, the auxiliary cross brace member 24 and auxiliary side frame members 28 form an auxiliary frame within the main frame 12. The cross brace member 24 is a direct replacement of the existing member 18. The member 24 is mounted to the frame 12 by mounting means, such as bolts 38, which held the member 18. The web slot 26 is defined between two spaced beams of the member 24, which are formed for rigidity. The member 24 performs the same support tasks as the member 18, and also acts to support the auxiliary side frame members 28. The members 28 are bolted to the member 24, and also to the main side frame members 16. Existing frame openings are used for mounting to the main side frame members 16, as by bolts 40 or the like.

The auxiliary side frame members 28 are shaped to accomodate the cylinders 20, while supporting the cylinders 30 and cylinder throw-off/impression mechanisms 42 (one is shown). The members 28 have narrow, lower portions extending upward from integral, actuator mounting castings adjacent the brace member 24. The lower portions are positioned between the cylinders 20. Atop the lower portions, the members 28 widen horizontally into impression cylinder mounting portions. Two horizontally spaced, two-part pillow blocks 44 are mounted on the impression cylinder mounting portions. The pillow blocks 44 support the cylinders 30. Each cylinder 30 is end mounted to pillow blocks 44, with interposed roller bearings for rotation of the cylinders 30 in relation to the blocks 44 and thereby the frame 12.

Figure 5:
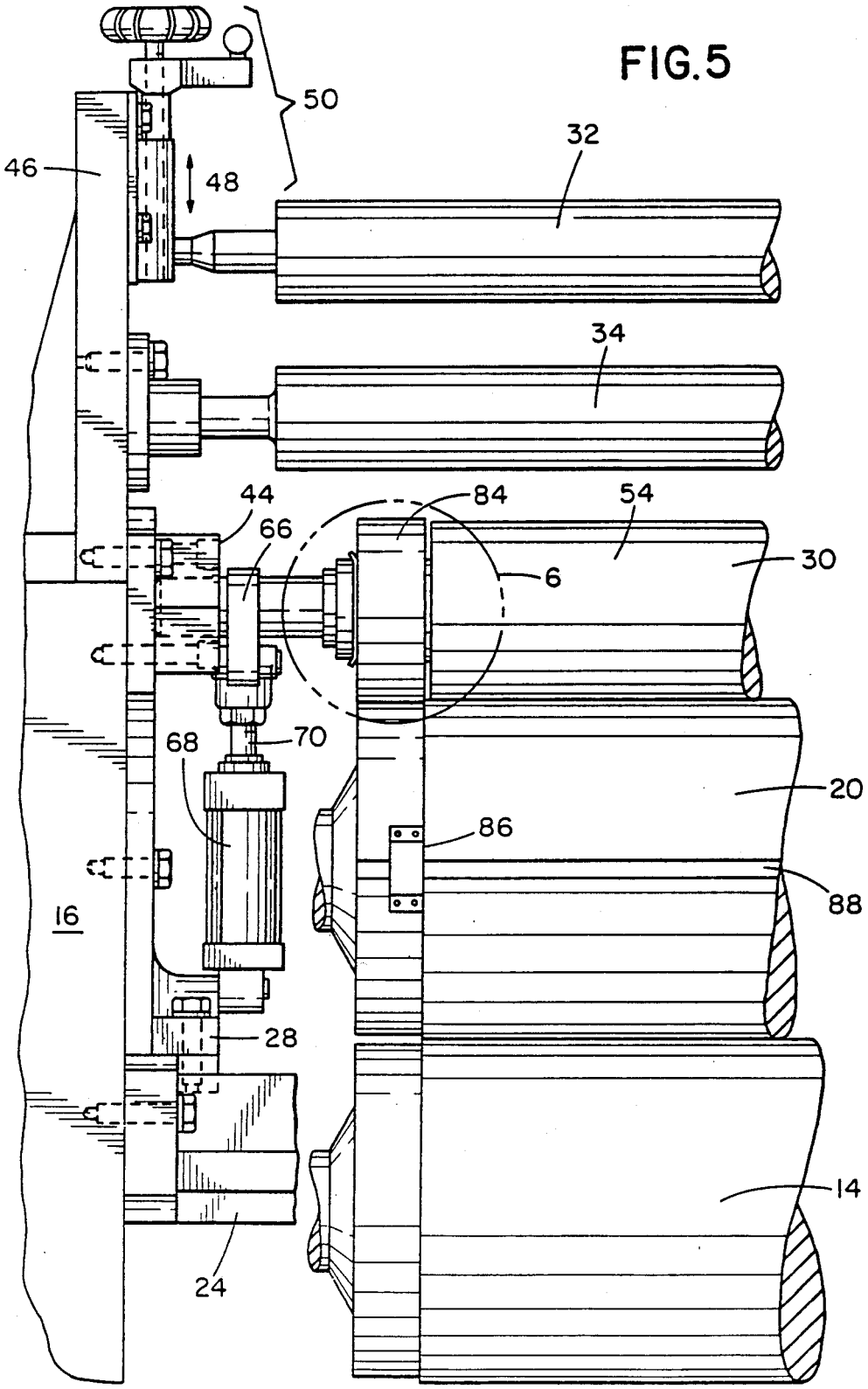
FIG. 5—FIG. 5 is a partial side elevation view of the converted press.

Continuing with FIG. 3, auxiliary side frame mounting brackets 46 (one is shown) are mounted to the auxiliary and main side frame members 28, 16. The brackets 46 are L-shaped, with horizontal foot portions and upwardly extending roller mounting portions. The foots are atop the members 16, outward of the members 28. A lip of each member 28 is bolted to the mounting portion of each bracket 46. The brackets 46 support the rollers 32, 34. As shown in FIG. 5, adjustment mechanisms 50 are included on the brackets 46 for adjustable mounting of the roller 32. Adjustment in the vertical direction, exemplified by arrow 48, is provided for coordaintion or timing of the printing of the two cylinders 20.

Figure 4:
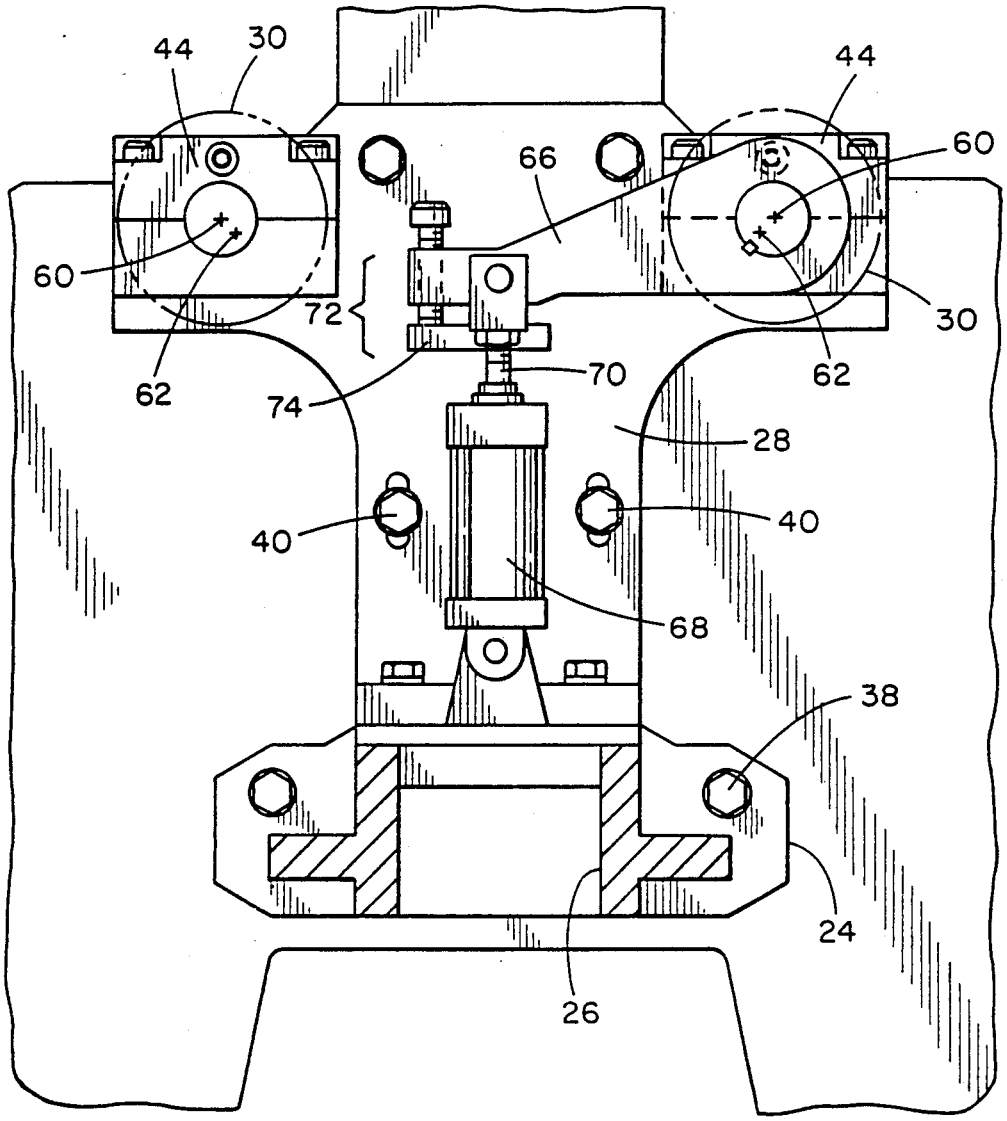
FIG. 4—FIG. 4 is a partial, elevation view of the converted press, with the cylinders removed, taken along line 4—4 of FIG. 3.
Figure 6:
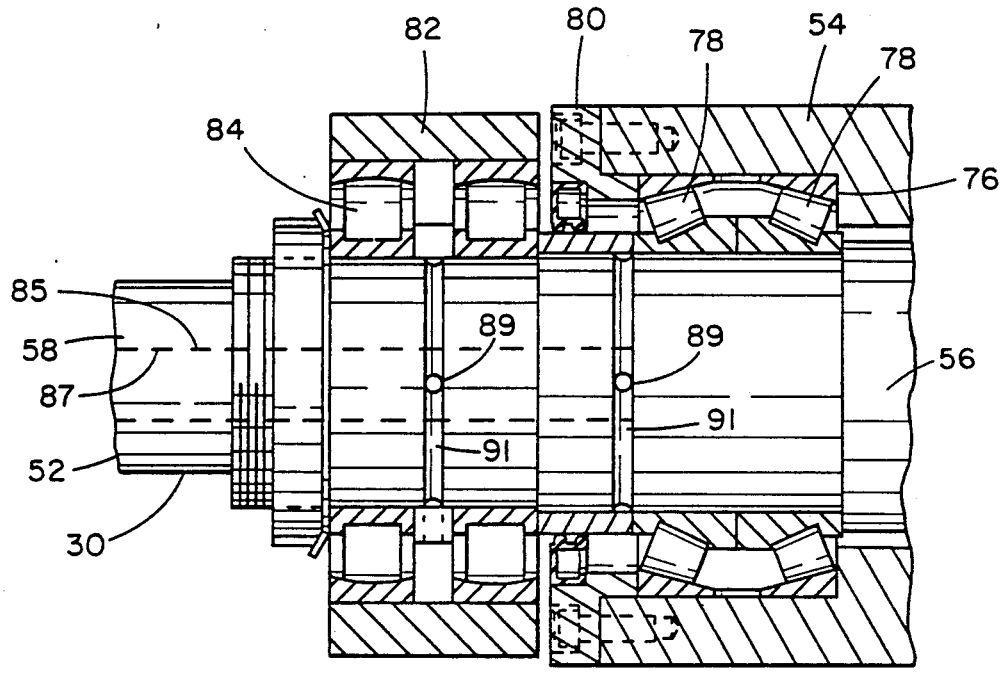
FIG. 6—FIG. 6 is a partially cross-sectioned, detail view taken of area 6 in FIG. 5; and FIG. 7

The impression cylinders 30, and throw-off/impression mechanisms 42, are constructed to throw the impression cylinders 30 both on and off. As shown in FIG. 6, each impression cylinder 30 includes a central shaft 52 and an independent impression cylinder surface member 54. The member 54 is concentrically mounted on a central portion 56 of the shaft 52, for rotation about the shaft 52. The member 54 provides the impression surface of the cylinder 30. When the cylinder 30 is on impression, the cylinder surface is friction driven by the web. Two end portions 58 (one is shown) are integrally formed into the shaft 52, on opposite ends of the central portion 56. The end portions 58 are eccentric to the central portion 56. As shown in FIG. 4, the centerlines 60 of the end portions 58 are offset from the centerlines 62 of the central portions 56. As a result, rotation of the shaft 52 rotates the impression cylinder surface into and out of impression contact with the corresponding blanket cylinder 20.

Advantage is taken of the eccentricity by the throw-off/impression mechanisms 42. As shown best in FIG. 4, each mechanism 42 includes an actuator arm 66 keyed to one of the end portions 58 of a shaft 52. The arm 66 is linked to an actuator 68, which includes a telescopic rod 70 for driving the arm 66. The linear position of the rod 70 controls the rotational position of the arm 66, the shaft 52 and thereby the impression cylinder surface. In one position of the rod 70 the cylinder 30 is thrown on impression, and in other positions, the cylinder 30 is off impression. The cylinder 30 is on impression in the position shown in FIG. 4. A mechanical stop 72 with a stop plate 74 affixed to the auxiliary side frame member 28 sets the "on impression" position of the mechanism.

Each cylinder 30 includes but one throw-off/impression mechanism 42. For one cylinder 30, the corresponding mechanism 42 is adjacent one auxiliary side frame member 28. For the other cylinder 30, the corresponding mechanism is adjacent the other member 28. The allocation of one mechanism 42 per cylinder 30 is a synergistic effect of the cylinder construction. The shaft 52 is a dead shaft in the sense that it does not rotate with the cylinder surface as the web passes the cylinder 30. The shaft 52 is so constructed and mounted that parallelism of the cylinders 20, 30, once set, is essentially constant. Rotation of the shaft 52 does not disturb the parallelism, and thus, one mechanism 42 is possible per shaft 52. The use of one mechanism per shaft, besides eliminating hardware, eliminates any skewing of the shaft due to lack of precise co-ordination between two or more mechanisms.

Referring again to FIG. 6, mounting of the member 54 to the shaft 52 is provided by pairs 76 (one is shown) of bearings 78. The bearings 78 are tapered roller bearings internally mounted between the central shaft portion 56 and the member 54, in a recess of the member 54. The pairs 76 are adjacent each end portion 58. A bearing retainer 80 is mounted to the end of the member 54 adjacent each pair 76, to retain the pairs 76 and pre-load the bearings 78. Location of the bearings 78 as described substantially eliminates bending stress in the cylinder 30, and the centrally faint printing which is the result of such stress.

Bearers 82 (one is shown in FIG. 6) for the cylinders 30 are located on the shaft central portin 56 adjacent each retainer 80. Each bearer 82 is a cylindrical metal ring. The bearer 82 is shrunk fit about bearings 84 for independent rotation about the shaft 52. The bearer 82 has an outer diameter reduced from the diameter of the member 54.

Bearer plates 86, shown in FIGS. 3 and 5, are located on the cylinders 20 in alignment with the blanket slots 88 of the cylinders 20. The bearer plates 86 are curved, and bridge the slots 88. The bearers 82 and plates 86 are co-operatively sized and located. The amount by which the outer diameters of the bearers 82 is reduced is equal to twice the amount by which the bearer plates 86 extend radially beyond the adjacent blankets on the cylinders 20. This amount is about equal to twice the radial thickness of the bearer plates 86. The bearers 82 and plates 86 are axially aligned and the bearers and plates contact on rotation of the cylinders 20, 30, to provide smooth movement of the impression cylinder surfaces across the slots 88. Bouncing of the cylinders 30 over the slots 88 is eliminated, improving print uniformity.

The bearer bearings 84 and other bearings 78 are lubricated by a lubrication circuit 85. The circuit 85 includes an axial channel 87 in the shaft 52, transverse openings 89 at the bearings, and circumferential grooves 91 in the shaft 52 at the bearings. Lubricant injected in the channel 87 spreads through the circuit 85 to the bearings 78, 84.

Figure 7:
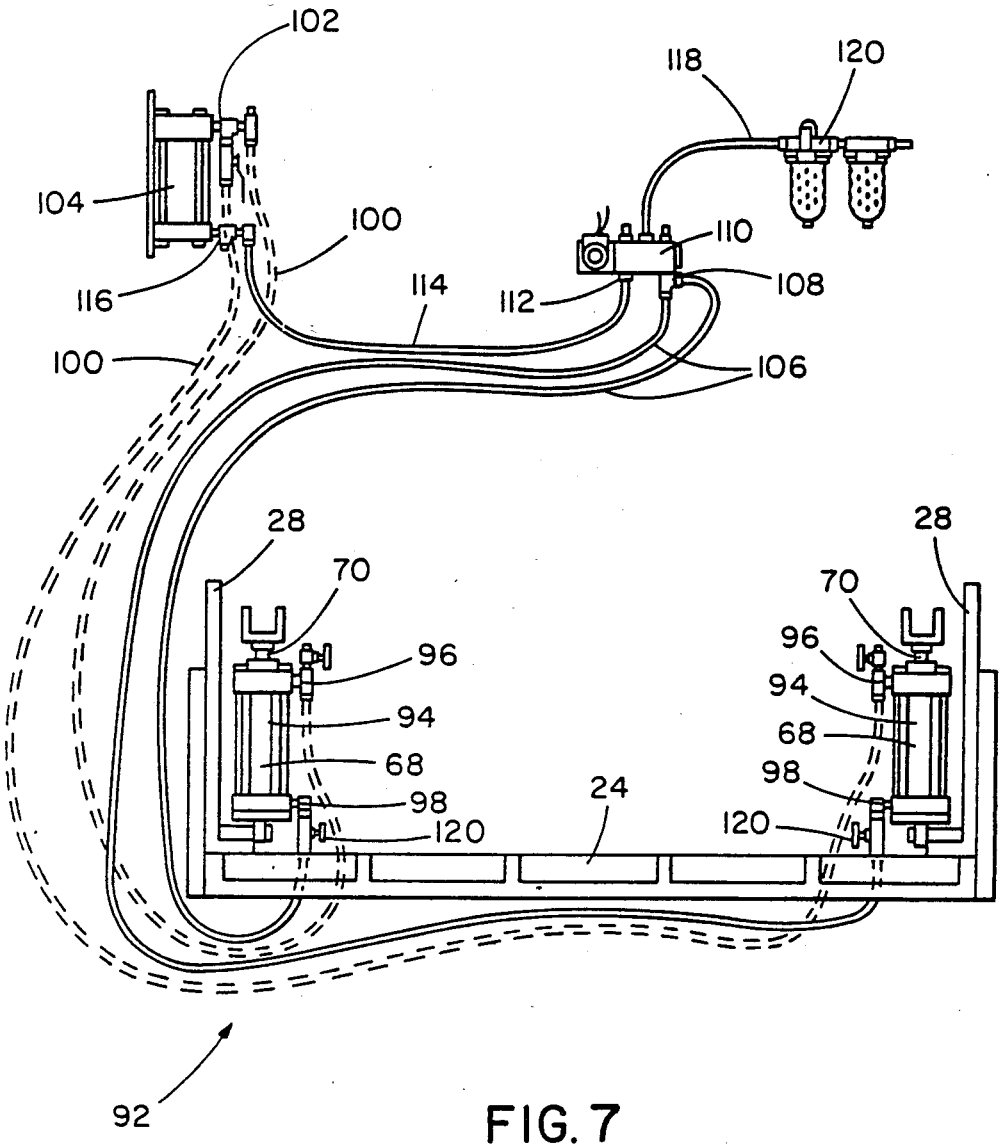
—FIG. 7 is a view of the impression cylinder control of the converted press.

The throw-off impression mechanisms 42 are part of an automatic control mechanism for the cylinders 20 generally designated 92 in FIG. 7. Each actuator 68 is a pressure actuated, telescoping member having a piston cylinder 94. A piston (not shown) is movably mounted in the cylinder 94. The piston is connected to the rod 70. Two piston cylinder inlets 96, 98 open into the cylinder 94 on opposite sides, or faces, of the piston. The introduction of a pressurized fluid to the inlet 96 drives the piston, piston rod 70 and thereby the corresponding impressing cylinder 30 to the position in which the impression cylinder 30 is on impression. The introduction of a pressurized fluid to the other inlet 98 drives the piston, piston rod 70 and thereby the impression cylinder 30 to the position in which the impression cylinder 30 is off impression. This second position is the position of FIG. 7.

Fluid lines create a fluid circuit between the cylinders 94, a reservoir 104 and a solenoid valve 110. Fluid lines 100 connect the inlets 96 to a first reservoir inlet 106, 102. Fluid lines connect the inlets 98 to an outlet 108 of the solenoid valve 110. A second outlet 112 of the solenoid valve 110 is connected by a fluid line 114 to a second reservoir inlet 116 of the reservoir 104. The valve 110 is supplied with pressurized gas, such as air, by a supply line 118 through filters 120.

The reservoir 104 includes a reservoir piston (not shown). The reservoir inlets 102, 116 are located on opposite sides of the reservoir piston. Between the reservoir piston and the pistons of cylinders 94, through lines 100 and inlets 96, 102, a substantially incompressible fluid such as hydraulic oil is provided.

The oil is driven to and from the reservoir 104 and cylinders 94 by the supplied air. In one state of operation of the valve 110, pressurized air is supplied to the line 114 and the lines 106 are vented. The air supply at reservoir inlet 116 drives the reservoir piston toward the inlet 102, forcing oil to the cylinders 94. The oil retracts the rods 70, moving the impression cylinders 30 to the on impression position and maintaining them there so long as the valve 110 remains in the one operating state. In a second state, the valve 110 vents the line 114 and supplies the lines 106. The air supply at piston cylinder inlets 98 drives the oil to the reservoir 104. Adjustable flow restrictors 120 control flow in the lines 106, to control the release of air from the piston cylinders 94.

The solenoid valve 110 is wired to control circuity (not shown). The valve 110 switches on command between the operating states. As most preferred, the valve 110 is wired with a web break detector, to throw-off the cylinders 30 in the event of a web break.

As now apparent, the substantially incompressible fluid (oil) holds the cylinders 30 on impression, while a gas (air) throws the cylinders 30 off impression. This construction reduces bounce of the cylinders 30 and improves print quality, while providing rapid throw-off of the cylinders 30.

What is claimed is:

1. In an apparatus for converting an existing, web-fed newspaper printing press into a web-fed, offset, newspaper printing press, the existing, web-fed, newspaper printing press having an existing main frame of two spaced, main side frame members, and two existing pairs of horizontally spaced cylinders rotatably mounted on the main frame side members, and the apparatus including means for converting one pair of the two existing pairs of cylinders into offset plate cylinders and means for converting the other pairs of the two existing pairs of cylinders into offset blanket cylinders, with a first of the offset blanket cylinders cooperating with a first of the offset plate cylinders, and a second of the offset blanket cylinders cooperating with a second of the offset plate cylinders, the improvement comprising:

a pair of auxiliary side frame members each mounted on one of the two spaced, main side frame members, each facing the other between the main side frame members and each including first and second offset impression cylinder mounting portions and an actuator mounting position;

a pair of auxiliary impression cylinders each having a dead shaft with a cylindrical central portion and two cylindrical end portions eccentric to the central portion, an annular, impression cylinder surface member having a cylindrical, outer, impression cylinder surface, and bearings for rotatably mounting the impression cylinder surface member on the central portion of the shaft;

a first of the pair of auxiliary impression cylinders being pivotably mounted by the end portions of the shaft thereof to the first offset impression cylinder mounting portions of the pair of auxiliary side frame members between the auxiliary side frame members and adjacent the first offset blanket cylinder, the first offset impression cylinder thereby being pivotable between a position, of the first offset impression cylinder surface, of offset impression contact with a web passed between the first offset impression cylinder and the first offset blanket cylinder, and a thrown-off position of no contact with the web, the first offset impression cylinder being friction driven by the web in the position of offset impression contact with the web;

a second of the pair of auxiliary impression cylinders being pivotably mounted by the end portions of the shaft thereof to the second offset impression cylinder mounting portions of the pair of auxiliary side frame members between the auxiliary side frame members and adjacent the second offset blanket cylinder, the second offset impression cylinder thereby being pivotable between a position, of the second offset impression cylinder surface, of offset impression contact with a web passed between the second offset impression cylinder and the second offset blanket cylinder, and a thrown-off position of no contact with the web, the second offset impression cylinder being friction driven by the web in the position of offset impression contact with the web;

first means for driving the first auxiliary impression cylinder in pivotal movement about the end portions thereof to move the impression cylinder surface to and from the offset impression contact and thrown-off positions, the first driving means including a first actuator arm mounted to one of the end portions of the shaft of the first auxiliary impression cylinder and a first actuator mounted to the first actuator arm and to the actuator mounting portion of one of the pair of auxiliary side frame members between the main side frame members of the press; and second means for driving the second auxiliary impression cylinder in pivotal movement about the end portions thereof to move the impression cylinder surface to and from the offset impression contact and thrown-off positions, the second driving means including a second actuator arm mounted to one of the end portions of the shaft of the second auxiliary impression cylinder and a second actuator mounted to the second actuator arm and to the actuator mounting portion of the other of the pair of auxiliary side frame members between the main side frame members of the press;

the first and second actuators being included in a drive, control and impression maintenance mechanism, the first actuator being a pressure actuated, telescoping member having a piston cylinder, a piston movably mounted in the piston cylinder, a piston rod connected to the piston and mounted to the first actuator arm, and two piston cylinder inlets to the piston cylinder positioned on opposite sides of the piston such that (a) introduction of a pressurized fluid to one of the inlet drives the piston, piston rod, first actuator arm and thereby the first auxiliary impression cylinder to the position of offset impression contact, and (b) the introduction of a pressurized fluid to the second of the inlets drives the piston, piston rod, first actuator arm and thereby the first auxiliary impression cylinder to the throw-off position, the second actuator being a pressure actuated, telescoping member having a piston cylinder, a piston movably mounted in the piston cylinder, a piston rod connected to the piston and mounted to the second actuator arm, and two piston cylinder inlets to the piston cylinder positioned on opposite sides of the piston such that (a) introduction of a pressurized fluid to one of the inlets drives the piston, piston rod, second actuator arm and thereby the second auxiliary impression cylinder to the position of offset impression contact, and (b) the introduction of a pressurized fluid to the second of the inlets drives the piston, piston rod, second actuator arm and thereby the second auxiliary impression cylinder to the thrown-off position;

means for selectively supplying a pressurized, substantially incompressible fluid to the one inlet of the first actuator and the one inlet of the second actuator;

means for selectively supplying a pressurized gas to the other of the inlets of the first actuator and the second actuator;

means for coordinating the two supplying means such that the pressurized gas and pressurized fluid are, on command, alternately supplied to and released from the inlets;

whereby the first and second auxiliary impression cylinders are driven into and maintained on impression by the incompressible fluid, to maintain a uniform impression, and thrown-off impression by the pressurized gas, to cause a rapid throw-off.

2. In an apparatus for converting an existing, web-fed newspaper printing press into a web-fed, offset, newspaper printing press, the existing, web-fed, newspaper printing press having an existing main frame of two spaced, main side frame members, and an existing pair of horizontally spaced cylinders rotatably mounted on the main frame side members, and the apparatus including means for converting one of the two existing cylinders into an offset plate cylinder and means for converting the other of the two existing cylinders into an offset blanket cylinder, with the offset blanket cylinder cooperating with the offset plate cylinder, the improvement comprising:

a pair of auxiliary side frame members each mounted on one of the two spaced, main side frame members, each facing the other between the main side frame members and each an offset impression cylinder mounting portion and an actuator mounting position;

an auxiliary impression cylinder having a dead shaft with a cylindrical central portion and two cylindrical end portions eccentric to the central portion, an annular, impression cylinder surface member having a cylindrical, outer, impression cylinder surface, and bearings for rotatably mounting the impression cylinder surface member on the central portion of the shaft;

the auxiliary impression cylinder being pivotably mounted by the end portions of the shaft thereof to the offset impression cylinder mounting portions of the pair of auxiliary side frame members between the auxiliary side frame members and adjacent the offset blanket cylinder, the offset impression cylinder thereby being pivotable between a position, of the offset impression cylinder surface, of offset impression contact with a web passed between the offset impression cylinder and the offset blanket cylinder, and a thrown-off position of no contact with the web, the offset impression cylinder being friction driven by the web in the position of offset impression contact with the web;

means for driving the auxiliary impression cylinder in pivotal movement about the end portions thereof to move the impression cylinder surface to and from the offset impression contact and thrown-off positions, the driving means including an actuator arm mounted to one of the end portions of the shaft of the auxiliary impression cylinder and an actuator mounted to the actuator arm and to the actuator mounting portion of one of the pair of auxiliary side frame members between the main side frame members of the press;

the actuator being included in a drive, control and impression maintenance mechanism, the actuator being a pressure actuated, telescoping member having a piston cylinder, a piston movably mounted in the piston cylinder, a piston rod connected to the piston and mounted to the actuator arm, and two piston cylinder inlets to the piston cylinder positioned on opposite sides of the piston such that (a) introduction of a pressurized fluid to one of the inlets drives the piston, piston rod, actuator arm and thereby the auxiliary impression cylinder to the position of offset impression contact, and (b) the introduction of a pressurized fluid into the second of the inlets drives the piston, piston rod, first actuator arm and thereby the auxiliary impression cylinder to the thrown-off position;

means for selectively supplying a pressurized, substantially imcompressible fluid to the one inlet of the actuator;

means for selectively supplying a pressurized gas to the other of the inlet of the actuator;

means for coordinating the two supplying means such that the pressurized gas and pressurized fluid are, on command, alternatively supplied to and released from the inlets;

whereby the auxiliary impression cylinder is driven into and maintained on impression by the incompressible fluid, to maintain a uniform impression, and thrown-off impression by the pressurized gas, to cause a rapid throw-off.

* * * * *